US008269602B2

(12) United States Patent
Graichen

(10) Patent No.: US 8,269,602 B2
(45) Date of Patent: Sep. 18, 2012

(54) SECURITY ACCESS CONTROL SYSTEM AND METHOD FOR MAKING SAME

(75) Inventor: Catherine Mary Graichen, Malta, NY (US)

(73) Assignee: UTC Fire & Security Americas Corporation, Inc., Bradenton, FL (US)

( * ) Notice: Subject to any disclaimer, the term of this patent is extended or adjusted under 35 U.S.C. 154(b) by 479 days.

(21) Appl. No.: 11/842,971

(22) Filed: Aug. 22, 2007

(65) Prior Publication Data

US 2009/0051528 A1 Feb. 26, 2009

(51) Int. Cl.
*G08B 29/00* (2006.01)

(52) U.S. Cl. ..... 340/5.7; 340/5.2; 340/541; 340/545.1; 340/686.1

(58) Field of Classification Search ..... 340/541–567, 340/5.2–5.74, 686.1–687
See application file for complete search history.

(56) References Cited

U.S. PATENT DOCUMENTS 3,947,838 A 3/1976 La Forge, Jr.
4,022,296 A * 5/1977 Mandel et al. ..... 187/395
4,516,114 A * 5/1985 Cook ..... 340/542
4,760,380 A * 7/1988 Quenneville et al. ..... 340/542
4,839,640 A * 6/1989 Ozer et al. ..... 340/5.33
4,938,027 A * 7/1990 Midlang ..... 62/80
5,235,143 A * 8/1993 Bahjat et al. ..... 187/316
5,319,362 A * 6/1994 Hyatt, Jr. ..... 340/5.33
5,479,151 A * 12/1995 Lavelle et al. ..... 340/542
5,801,625 A * 9/1998 Wang ..... 340/506
6,111,502 A * 8/2000 Lenglart et al. ..... 340/541
6,297,739 B1 * 10/2001 Small ..... 340/573.3
6,401,466 B1 * 6/2002 Olsen ..... 62/131
6,453,687 B2 * 9/2002 Sharood et al. ..... 62/127
6,496,220 B2 * 12/2002 Landert et al. ..... 348/143
6,647,735 B2 * 11/2003 Street et al. ..... 62/132
6,748,061 B2 * 6/2004 Ahlstrom et al. ..... 379/102.06
7,065,409 B2 * 6/2006 Mazar ..... 607/60
7,183,895 B2 * 2/2007 Bazakos et al. ..... 340/5.7
7,382,895 B2 * 6/2008 Bramblet et al. ..... 382/103
7,644,299 B2 * 1/2010 Kosaka ..... 714/4.1
7,716,937 B2 * 5/2010 Schenk et al. ..... 62/228.4
2002/0067259 A1 6/2002 Fufidio et al.
2002/0154021 A1 * 10/2002 Skerker et al. ..... 340/679
2005/0002530 A1 1/2005 Kogan et al.
2008/0290151 A1 * 11/2008 Usmani ..... 232/35
2009/0025435 A1 * 1/2009 Popowski ..... 70/91

* cited by examiner

*Primary Examiner* — Albert Wong
*Assistant Examiner* — Ryan Sherwin
(74) *Attorney, Agent, or Firm* — MH2 Technology Law Group, LLP

(57) ABSTRACT

A security system to identify a true door forced open alarm is provided. The security system includes an electronic entry means configured to allow access through a door. The security system also includes a request to exit device configured to indicate a request to exit the door. The security system also includes a logic unit configured to control access through the door and determine whether an open state of the door is allowed.

20 Claims, 2 Drawing Sheets

SECURITY ACCESS CONTROL SYSTEM AND METHOD FOR MAKING SAME

BACKGROUND

The invention relates generally to security systems and more particularly, to security systems to control access through a doorway.

Physical security access control systems receive a significant volume of alarms requiring a response from a security staff. Known security access control systems do not differentiate between true alarms (where access has been obtained fraudulently) and false alarms. From experience, instances may occur in which the security staff assumes some alarms are false and do not investigate further. An example of a false door forced open alarm includes a loose door that may trigger such an alarm. Furthermore, in case of a limited security staff, it may not be plausible to investigate each alarm in a timely fashion. Hence, a better classification of a type of alarm is required to design an alarm criteria appropriate for security risk and that would allow the security staff to prioritize and tailor a response accordingly.

One typical hardware solution to avoid a loose door scenario has been to install magnetic locks that will not release when a person pulls on a door. Contacts installed in the door and frame may have different tolerances to determine when the door has been opened. Another typical solution includes elimination of a passive request to exit device and adding hardware having a shorter recovery period, such as a crash bar. However, these solutions are not cost effective and are not feasible at sites having a large number of doors to protect.

Therefore, an improved security access system is desirable to address one or more of the aforementioned issues.

BRIEF DESCRIPTION

In accordance with an aspect of the invention, a security system to identify a true alarm is provided. The security system includes an electronic entry means configured to allow access through a door. The security system also includes a request to exit device configured to indicate a request to exit the door. The security system also includes a sensor device configured to detect an open door. The security system further includes a logic unit configured to control access through the door and determine whether an open state of the door is allowed.

In accordance with another aspect of the invention, a method for making a security system is provided. The method includes providing a sensor for sensing separation of a door from a frame indicating if the door is open. The method also includes providing a request for entry or exit device to permit access through the door. The method further includes providing a timer for monitoring a time period between the separation of the door and closing of the door. The method also includes providing a logic unit in communication with the timer for determining if the time period is less than a threshold time limit and for classifying the access into a type of alarm.

These and other advantages and features will be more readily understood from the following detailed description of preferred embodiments of the invention that is provided in connection with the accompanying drawings.

DRAWINGS

DETAILED DESCRIPTION

Embodiments of the invention are directed to a security access control system and a method for the same. As used herein, the term "security access control system" refers to a security system to control access through a door having an electronic means to enter or exit. Further, the term 'door' as used here, encompasses regular doors, cargo doors and other like portals.

Figure 1:
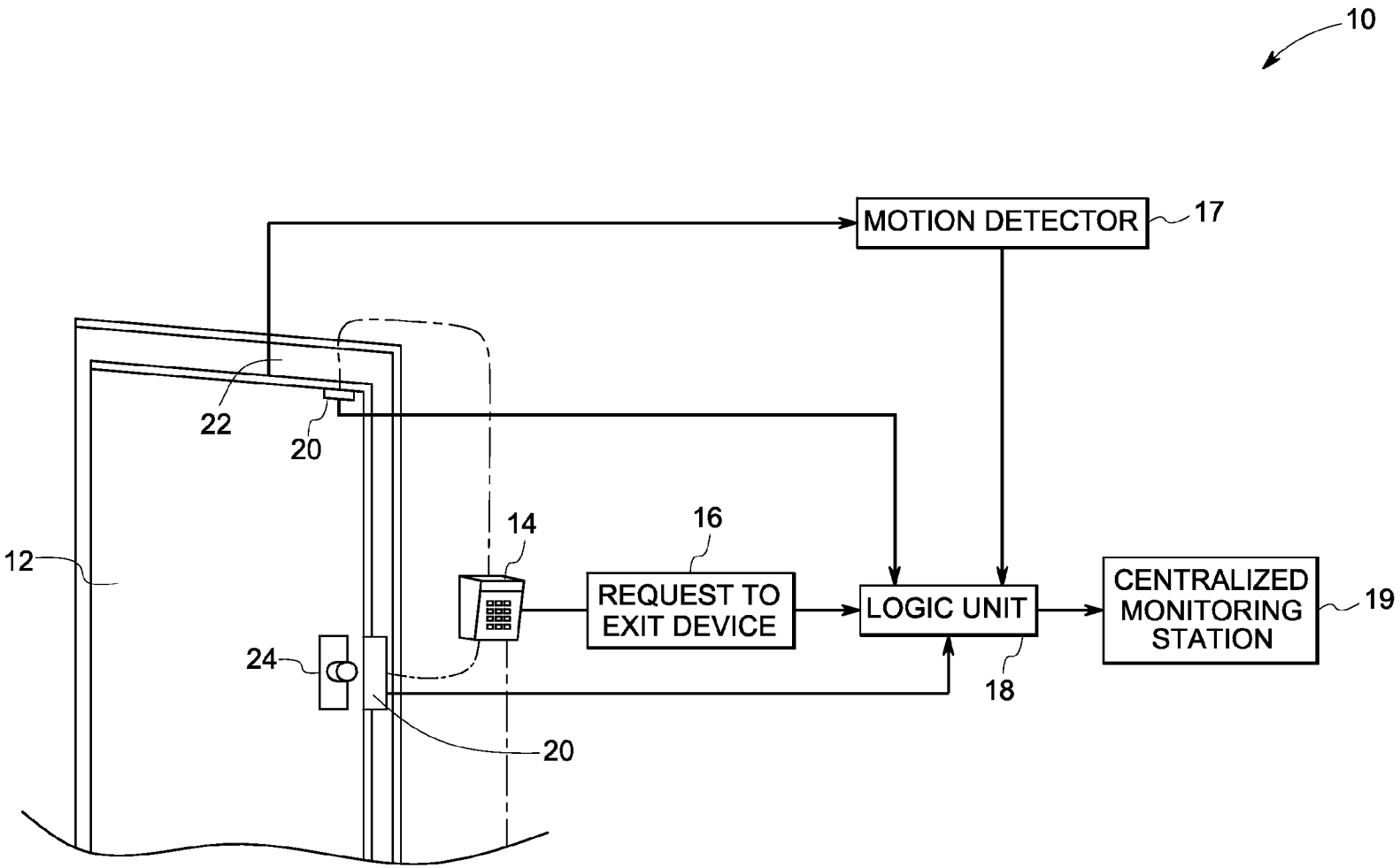
FIG. 1 is a schematic illustration of an exemplary security access control system in accordance with an embodiment of the invention.

Referring to the drawings, FIG. 1 is a schematic illustration of a security access control system 10 to identify a true door forced open alarm for a door 12. As used herein, the term 'true door forced open alarm' refers to a door forced open. Similarly, a 'false door forced open alarm' refers to scenarios other than the true door forced open alarm. The door 12 includes an electronic entry means 14 that allows access. In particular embodiments, the electronic entry means 14 may include a keypad entry, a card reader or a biometric identifier such as a fingerprint reader, an iris scan reader or a facial feature matching reader. The electronic entry means 14 receives credentials to allow access from a user and sends information to a logic unit 18 to validate the credentials. If validated, the logic unit 18 sends a signal to an electronic door lock to unlock and allows access. In one embodiment, the electronic entry means 14 may be located internally to the door 12 and a user must present valid credentials within a pre-determined time period after opening the door to prevent an alarm. Non-limiting examples of such an embodiment are residential or small security systems using a keypad behind a door locked with a key.

The security system 10 performs an initial logic to detect whether the door 12 is open. This is also referred to as an 'open state'. Multiple sensors 20 installed on the door 12 detect separation of the door from a frame 22. In a particular embodiment, the sensors 20 are installed on the door 12 and the frame 22. In another embodiment, one of the sensors 20 is installed in a door latch 24. In an example, at least one of the sensors 20 is a magnetic sensor. Once a separation is detected, the system 10 also detects if the door 12 is closed by detecting the sensors 20 in a 'closed state'. Changes in a state of the door 12 are communicated to the logic unit 18.

In a particular embodiment, the request to exit device 16 is a motion detector and may be installed inside the door 12 to provide a "request to exit" signal. In another embodiment, the request to exit device 16 is a crash bar or a push button device that allows the door 12 to be physically unlocked without communication with the logic unit 18 if power is interrupted. In another exemplary embodiment, an external motion detector 17 may be installed outside of the door 12, positioned to detect motion of a person entering or exiting the door. As used herein, the term motion detector refers to either the request to exit device 16 when it is a motion detector or to the external motion detector 17.

In one embodiment, the motion detector sends a motion event to the logic unit 18 when motion is detected. The motion detector enters a reset time period where events are not transmitted. When the reset time period expires, a motion event is sent the next time the motion detector observes motion. The logic unit 18 uses the 'open state' signal received from the sensors 20 and any additional signals received from the electronic entry means 14 and the motion detector(s) to determine whether to send an alarm signal to a centralized monitoring system 19. The logic unit 18 coupled to the request to exit device 16 classifies different alarms and controls access through the door 12. The centralized monitoring station 19 coupled to the logic unit 18 allows remote monitoring of the door 12.

There are various scenarios for the false door forced open alarm to be triggered. In a particular embodiment, the false alarm refers to a loose door scenario. Such a false door forced open alarm may also be referred to as a 'loose door alarm'. Typically, when a person opens and passes through a doorway, a minimum amount of time is required for the door to close and reset. When the door is loose, a person may attempt to open the door that is locked, but the door will not open completely. In such a situation, the security system 10 distinguishes from a forced open door scenario and a loose door alarm.

In a particular embodiment, the 'true door forced open alarm' is created when the door 12 is opened and no validated credentials are presented to the electronic entry means 14. In another embodiment, the 'true door forced open alarm' is triggered when the door 12 is opened and no request to exit signal is received from the request to exit device 16.

When the closed state is detected within a configurable time limit threshold after the open state that would normally create a door forced open alarm, a 'loose door alarm' is triggered instead. When the closed state is not detected within the configurable time limit threshold after the open state meeting other door forced open alarm conditions, a 'forced door alarm' is triggered. In one embodiment, the system 10 includes a timer to detect the period of time between opening and closing of the door 12.

The request to exit device 16 provides further confirmation of a loose door when it is a motion detector. Consider an exemplary embodiment, wherein the request to exit device 16 is a motion detector installed inside of the door 12. If there is no motion detected inside of the door once the door 12 is opened and the door 12 closes within the configurable time limit, a "loose door alarm" is triggered, since no motion detected inside implies that no one actually passed through the door 12. In another embodiment, if motion is detected inside the door 12 even if the door 12 closes within the configurable time limit, then a door forced open alarm is triggered. This is a more conservative embodiment to lower the chance that a forced door scenario has occurred undetected, but requires more complexity in the implementation and additional motion detectors.

The 'loose door alarm' may further be classified as an 'attended' and an 'unattended' loose door alarm. A security site may place different priorities on attended and unattended loose door alarms, since they represent different types of scenarios. Consider a particular embodiment, wherein a motion detector 17 is installed outside of the door 12. When there is no motion detected at an entry and the door 12 opens and closes within the configurable time limit, it may be termed as an 'unattended' loose door alarm. In a non-limiting example, a heating or a ventilation system may create sufficient pressure to force open the door 12 and close the door 12 in small amounts, but sufficient enough to break a contact, an 'unattended' loose door alarm is triggered. In another example, an 'unattended' loose door alarm is triggered. if heavy motor vehicle traffic near the door 12 causes it to separate enough to create the open state. Unattended loose door alarms represent environmental factors causing the door sensors to break the contacts. In another embodiment, when there is motion detected outside the door 12 and the door 12 opens and closes within the configurable time limit, an 'attended' loose door alarm is activated. In an example, when a person pulls on the door 12 without presenting valid entry credentials to the electronic entry means 14 causing it to open and the door contacts to separate, the door does not fully open but the person will release the door 12 enough to allow it to return to the closed state.

In another exemplary embodiment, a 'rapid exit alarm' is triggered. In a 'rapid exit alarm' scenario, the system 10 monitors a request to exit via the request to exit device 16. Typically, a short time window, which may also be referred to as 'normal time limit', is allowed for the door 12 to be opened from the inside to exit, after the request to exit device 16 is activated. In a case of successive opening of the door 12 within a short time period such as, but not limited to, on the order of a few seconds, without another request to exit signal (such as from a motion detector), the 'rapid exit alarm' is activated. A time limit as to when a second door open detection may occur is set based upon a recovery time of the request to exit device 16. In another embodiment, when an individual requests to exit and does not immediately open the door 12 such as, for example, when completing a conversation, the door 12 is opened beyond the normal time limit. If the door 12 is opened within the time limit set for a second door open detection, a 'slow exit alarm' is activated.

Furthermore, in yet another exemplary embodiment, if the motion detector 17 is installed outside of the door 12 detects motion after the door 12 is opened within a desired time limit, then the 'rapid exit' or the 'slow exit' alarm is triggered. On the contrary, if the motion detector 17 detects motion outside of the door 12 prior to opening of the door 12, a 'forced door open alarm' is generated, since it implies that someone may have approached from the outside and opened the door 12.

Figure 2:
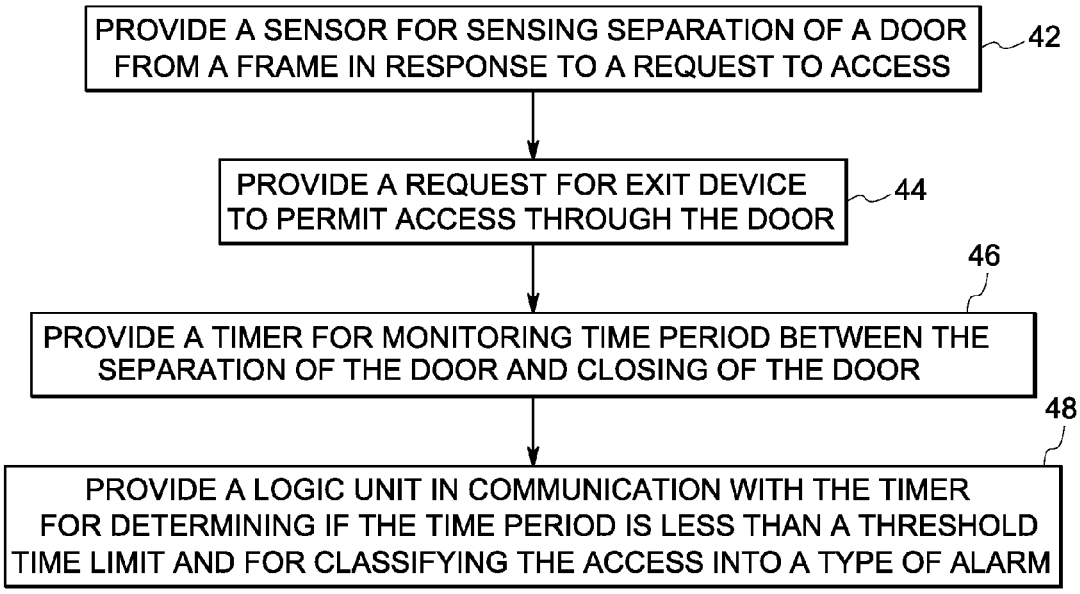
FIG. 2 is a flow chart representing steps in an exemplary method for making a security control system in accordance with an embodiment of the invention.

FIG. 2 is a flow chart representing steps in an exemplary method for making a security system. The method includes providing a sensor for sensing separation of a door in step 42. In a particular embodiment, the sensor is installed on at least one of the door or the frame. In another embodiment, the sensor is installed on a door latch. A request for exit device is provided at the door to permit access and egress through the door without alarms in step 44. A timer is provided to monitor a time period between the separation of the door and closing of the door in step 46. A logic unit in communication with the timer is provided in step 48 to determine if the time period is less than a threshold limit and for classifying the access into a type of alarm. The logic unit is also in communication with the electronic entry means 14 and the request to exit device 16, such as, but not limited to, the motion detector. The logic unit is also in communication with an external motion detector 17 installed external to the door. In a particular embodiment, the logic unit includes a microcontroller.

The various embodiments of a security access control system and method described above thus provide a way to achieve a convenient and efficient means of differentiating true door forced open alarms from false alarms. This technique also provides greater configuration capabilities and specifics about potential security breaches. Further, the system and technique allows for reduction in security load and risks.

It is to be understood that not necessarily all such objects or advantages described above may be achieved in accordance with any particular embodiment. Thus, for example, those skilled in the art will recognize that the systems and techniques described herein may be embodied or carried out in a manner that achieves or optimizes one advantage or group of advantages as taught herein without necessarily achieving other objects or advantages as may be taught or suggested herein.

Furthermore, the skilled artisan will recognize the interchangeability of various features from different embodiments. For example, the use of a motion detector installed outside of a door with respect to one embodiment can be adapted for use with a magnetic sensor installed on a door latch described with respect to another. Similarly, the various features described, as well as other known equivalents for each feature, can be mixed and matched by one of ordinary skill in this art to construct additional systems and techniques in accordance with principles of this disclosure.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed as new and desired to be protected by Letters Patent of the United States is:

1. A security system comprising:

an electronic door lock attached to a door that unlocks the door from a door frame after receiving an unlock signal, wherein the door controls access to, and is situated between, an inside and an outside;

an electronic entry device located on the outside of the door for receiving a credential;

a request to exit device located on the inside of the door, the request to exit device sending a request to exit signal when the request to exit device is activated;

a sensor that detects that the door is in an open state or a closed state; and a logic unit connected to the electronic entry device, the request to exit device, and the sensor, wherein the logic unit determines:

a loose door scenario if no valid credential has been received, there is no request to exit signal, and the sensor has detected that the door has been in the open state for a first length of time that is shorter than or equal to a threshold time limit; and a forced open door scenario if no valid credential has been received, there is no request to exit signal, and the sensor has detected that the door has been in the open state for a second length of time that is longer than the threshold time limit.

2. The security system of claim 1, and further comprising:

a centralized monitoring system;

wherein the logic unit sends to the centralized monitoring system a loose door alarm signal or a forced open door alarm signal when the logic unit determines the loose door scenario or the forced open door scenario, respectively.

3. The security system of claim 1, and further comprising:

a motion detector for detecting motion outside of the door;

and wherein the logic unit further determines:

an attended loose door scenario if no valid credential has been received, there is no request to exit signal, motion has been detected, and the sensor has detected that the door is in the open state for the first length of time; and an unattended loose door scenario if no valid credential has been received, there is no request to exit signal, motion has not been detected, and the sensor has detected that the door has been in the open state for the first length of time.

4. The security system of claim 3, and further comprising:

a centralized monitoring system;

wherein the logic unit sends to the centralized monitoring system an attended loose door alarm signal, an unattended loose door alarm signal, or a forced open door alarm signal when the logic unit determines the attended loose door scenario, the unattended loose door scenario, or a forced open door scenario, respectively.

5. The security system of claim 1, wherein the logic unit further determines a rapid exit scenario wherein:

there is a request to exit signal and a third length of time passes before the door is in the open state a first instance, wherein the third length of time is shorter than a normal time limit; and the door is in the open state a second instance and a fourth length of time passes after the first instance the door is in the open state, wherein the fourth length of time is shorter than a recovery time of the request to exit device.

6. The security system of claim 5, and further comprising:

a centralized monitoring system;

wherein the logic unit sends to the centralized monitoring system a rapid exit alarm signal, a loose door alarm signal, or a forced open door alarm signal when the logic unit determines the rapid exit scenario, the loose door scenario, or the forced open door scenario, respectively.

7. The security system of claim 1, wherein the logic unit further determines a slow exit scenario wherein:

there is a request to exit and a third length of time passes before the door is in the open state a first instance, wherein the third length of time is longer than a time limit; and the door is in the open state a second instance and a fourth length of time passes after the first instance the door is in the open state, wherein the fourth length of time is shorter than a recovery time of the request to exit device.

8. The security system of claim 7, and further comprising:

a centralized monitoring system;

wherein the logic unit sends to the centralized monitoring system a slow exit alarm signal, a loose door alarm signal, or a forced open door alarm signal when the logic unit determines the slow exit scenario, the loose door scenario, or the forced open door scenario, respectively.

9. The security system of claim 1, wherein the request to exit device is a motion detector.

10. The security system of claim 1, and further comprising:

a timer for detecting a length of time that the door is in the open state.

11. The security system of claim 1, wherein the electronic entry device comprises at least one of: a keypad entry, a card reader, and a biometric reader, wherein the biometric reader comprises at least one of: a fingerprint reader, an iris scan reader, and a facial feature matching reader.

12. A method of controlling access through a door, the method comprising:

receiving an input representing a credential for access through the door;

receiving a request to exit signal representing a request to pass through the door from an inside of the door to an outside of the door;

detecting whether the door is in an open door state or a closed door state;

generating a loose door alarm signal if a valid credential has not been received, no request to exit signal has been detected, and an open door state has been detected, wherein, the open door state lasts for a first length of time that is shorter than or equal to a threshold time limit; and generating a door forced open alarm signal if a valid credential has not been received, no request to exit signal has been detected, and an open door state has been detected, wherein the open door state lasts for a second length of time that is longer than the threshold time limit.

13. The method of claim 12, wherein the input representing the credential comprises at least one of: a keypad entry, a card reading, and a biometric reading, wherein the biometric reading represents at least one of: a fingerprint reading, an iris scanning, and a facial feature matching.

14. The method of claim 12, wherein the request to exit signal representing the request to pass through the door comprises detecting motion on the inside of the door.

15. The method of claim 12, and further comprising:

detecting motion in an area near the outside of a door;

generating an attended loose door alarm signal if a valid credential has not been received, no request to exit signal has been detected, motion has been detected, and the open door state has been detected, wherein the open door state lasts for the first length of time that is shorter than the threshold time limit; and sending an unattended loose door alarm signal if a valid credential has not been received, no request to exit signal has been detected, no motion has been detected, and the open door state has been detected, wherein the open door state lasts for the first length of time that is shorter than the threshold time limit.

16. The method of claim 12, and further comprising:

validating the input representing the credential.

17. The method of claim 12, and further comprising:

generating a rapid exit alarm signal if:

the request to exit signal has been detected and the open door state has been detected, wherein a third length of time between the detection of the request to exit signal and the detection of the open door state is shorter than a time limit; and the open door state is detected again, wherein a fourth length of time between detection of the open door states is shorter than a recovery time of a request to exit device.

18. The method of claim 17, wherein the request to exit device is a motion detector.

19. The method of claim 12, and further comprising:

generating a slow exit alarm signal if:

the request to exit signal has been detected and the open door state has been detected, wherein a third length of time between the detection of the request to exit signal and the detection of the open door state is longer than a time limit; and the open door state is detected by the logic unit again, wherein a fourth length of time between detection of the open door states is shorter than a recovery time of a request to, device.

20. The method of claim 19, wherein the request to exit device is a motion detector.

* * * * *